US005467643A

United States Patent [19]

Barnett et al.

[11] Patent Number: 5,467,643

[45] Date of Patent: Nov. 21, 1995

[54] METHOD AND APPARATUS FOR MONITORING WATER FLOW IN A MARINE ENGINE COOLING WATER SYSTEM AND A BILGE WATER PUMPING SYSTEM

[76] Inventors: Michael L. Barnett, Rte. #1, Box 3700, Coquille, Oreg. 97423; Larry G. Brader, 538 SW. 283rd St., Federal Way, Wash. 98023

[21] Appl. No.: 290,390

[22] Filed: Aug. 15, 1994

[51] Int. Cl.[6] ..... G01L 15/00

[52] U.S. Cl. ..... 73/116; 73/118.1

[58] Field of Search ..... 73/116, 117.3, 73/118.1

[56] References Cited

U.S. PATENT DOCUMENTS

| | | | |
|---|---|---|---|
| 3,793,997 | 2/1974 | Banner | 73/118 |
| 4,485,794 | 12/1984 | Kimberley et al. | 123/569 |
| 4,630,036 | 12/1986 | Ford | 340/606 |
| 4,887,068 | 12/1989 | Umehara | 73/308 |
| 4,934,970 | 6/1990 | Lamprey | 440/2 |
| 5,004,439 | 4/1991 | Onoue | 440/2 |
| 5,007,286 | 4/1991 | Malcolm et al. | 73/181 |
| 5,016,006 | 5/1991 | Umehara | 340/984 |
| 5,330,376 | 7/1994 | Okumura | 440/88 |

*Primary Examiner*—Richard Chilcot
*Assistant Examiner*—Max H. Noori
*Attorney, Agent, or Firm*—Stratton Ballew

[57] ABSTRACT

A new method and apparatus for monitoring cooling water flow in a marine engine cooling water system to determine the functional status, and efficiency, of a marine engine cooling system and also monitoring bilge water flow in a bilge water pumping system to determine the functional status, and efficiency, of the bilge water pumping system.

16 Claims, 17 Drawing Sheets

METHOD AND APPARATUS FOR MONITORING WATER FLOW IN A MARINE ENGINE COOLING WATER SYSTEM AND A BILGE WATER PUMPING SYSTEM

TECHNICAL FIELD

The invention relates to a method and apparatus for monitoring the functional status of an engine cooling system and a bilge pumping system, in a marine vessel. Specifically, the invention relates to a method and apparatus for monitoring cooling water flow in a marine engine cooling water system to determine the functional status of a marine engine cooling system and also monitoring bilge water flow in a bilge water pumping system to determine the functional status of the bilge water pumping system.

BACKGROUND OF THE INVENTION

The uninterrupted flow of cooling water through marine combustion engines used for propulsion or to generate electrical power is essential to their operation. Even brief failure of cooling water flow through a marine engine can cause overheating and resultant engine damage or failure. Failure of cooling water flow is nearly impossible to avoid however, because most marine engine cooling systems rely on sea or lake water, drawn into the system via intake ports or a sea cock, as a heat transfer medium for cooling the engine. Although this design provides an unlimited supply of cooling water, there is a significant chance that waterborne debris, seaweed, dirt or dissolved minerals will foul the intake port, clog internal channels in the cooling system, damage the impeller of the cooling system pump, or damage other types of water pump mechanisms (such as piston or diaphragm based pumps), all leading to cooling system failure.

When fouling or clogging of a marine engine cooling system occurs, the flow of cooling water through the engine becomes reduced, or shuts off completely, leading to overheating and potential damage to or failure of the engine. A reduction of cooling water flow can also create a powerful vacuum in the pipes and hoses which carry water from the water intake port to the water pump and engine, resulting in the collapse or rupture of these pipes or hoses. This problem is particularly troublesome in wire reinforced rubber hoses with an internal rubber liner, because the internal liner can collapse due to a vacuum, yet the external appearance of the wire reinforced shell remains unaffected, making it difficult to identify or locate the problem. To prevent these effects, the operator or engineer of the vessel must be able to quickly ascertain whether impairment or failure of the cooling system has occurred, in order to restore cooling water flow through the engine promptly before overheating damage can result.

While it is known to monitor marine engine overheating using temperature sensors, such devices do not indicate whether the overheating is due to cooling system failure, or is attributable to some other potential cause, such as increased engine load. Engine overheating due to cooling system failure almost certainly results in engine damage, whereas other overheating causes are typically less drastic, and often harmless, in their effects. Consequently, the inability to distinguish among causes of overheating renders troubleshooting more complicated and time consuming, and can result in unnecessary alarm over innocuous overheating events, or inattention to serious overheating problems.

More importantly, it is generally ill-advised to rely on engine temperature sensors to monitor cooling system failures, because engine damage can occur so rapidly after cooling failure that sensors may not register the problem until it is too late to avoid engine damage.

The poor reliability of engine temperature sensors for monitoring marine cooling system function is widely recognized. To overcome this problem, most marine engine operators currently monitor their cooling system's function directly, by visually inspecting the output of cooling water from the engine's exhaust port. This typically requires that the operator leave the helm of the vessel, walk to the stern of the vessel, and peer over the rail to view the exhaust port. These activities result in obvious personal and traffic safety hazards, regardless of whether or not a crew member is available to assume the operator's duties during the inspection. Furthermore, the vessel's cooling water exhaust port is often not observable due to rough waters, darkness, or physical obstructions, such as a stern mounted swim step, all of which impair the operator's view. Likewise, the inspection may be omitted due to operator inadvertence or activity conflicts. Lastly, visual inspections of cooling system function are by nature highly subjective and prone to inaccuracy. Low to intermediate cooling water flow levels may be interpreted by an inexperienced crew member as adequate, even though such levels may actually reflect critical impairment of the cooling system.

The integrity of the cooling water pump impeller, and other types of water pump mechanisms, is critical to effective operation of the cooling system. Preventative maintenance is currently the only reliable means to insure the impeller or pump remains functionally intact. Impellers and water pumps are periodically replaced at considerable expense for fear that they may soon fail. Assuredly, impeller or water pump failure results in the immediate loss of the marine engine cooling system and almost certainly results in engine damage because its failure is often undetected at least long enough to result in extensive damage, ergo expensive repairs and downtime.

The poor reliability of bilge water pumping systems are also widely recognized. In an attempt to overcome this problem, most marine engine operators currently monitor their bilge water pumping system's function directly, by visually inspecting the output of bilge water from the vessel's bilge water outlet port. This typically requires that the operator leave the helm of the vessel, walk to the outer rail of the vessel, and peer over the rail to view the outlet port. These activities result in obvious personal and traffic safety hazards, regardless of whether or not a crew member is available to assume the operator's duties during the inspection. Furthermore, the vessel's bilge water outlet port is often not observable due to rough waters, darkness, or physical obstructions such as hull curvature, all of which impairs the operator's view. Likewise, the inspection may be omitted due to operator inadvertence or activity conflicts. Lastly, visual inspections of bilge water pumping system function are by nature highly subjective and prone to inaccuracy. Low to intermediate bilge water flow levels may be interpreted by an inexperienced crew member as adequate, even though such levels may actually reflect critical impairment of the bilge water pumping system. Pump vibration and noise may also indicate the operation of the bilge water pumping system; however, this is a subjective observation and does not indicate how well the system is working, or if any bilge water is actually being pumped at all. Also the vessel operator may not be aware of the immediate need for bilge water pumping. Bilge water pumping systems often activate and operate automatically, but can also be activated and operated manually.

Bilge water pumps can use impellers, diaphragms, or pistons as the pumping mechanism, and all of these need to be monitored to evaluate their long term performance. Failure of the bilge water pump is nearly impossible to avoid, because the water extracted from the vessel by the bilge pump often contains debris and contaminants generated by the vessel itself, or objects or dissolved minerals present in water which leaks into the vessel. Consequently, bilge water pump intake ports and outflow pipes need frequent inspection and cleaning, and bilge pumps themselves need routine maintenance and replacement.

The integrity of the bilge water pump is critical to effective operation of the bilge water pumping system. Preventative maintenance is currently the only reliable means to insure the impeller or water pump remains functionally intact. The bilge pump mechanism is periodically replaced at some expense for fear that it may soon fail. Assuredly, pump failure results in the immediate loss of the bilge water pumping system and thus results in the inability to remove accumulated bilge water at perhaps a vital time.

The pumping of bilge water is a critical process on board a marine vessel. The accumulation of water on a vessel for any reason—hull leaks, rain, cooling system malfunction or foul weather—will likely result in damage or in an extreme case, sinking of the vessel. Also, a long term increase in the rate at which water is monitoring bilge water pumping system function which employs direct monitoring of bilge water outflow through the bilge water pumping.

A need also exists for a method and apparatus for directly monitoring bilge water outflow in a bilge water pumping system, which provides timely detection of bilge water pumping system impairment to allow the vessel operator to take corrective action against leaking before water damage or sinking occurs.

An additional need exists for the monitoring of the long term performance of the bilge water pumping system by measuring the water outflow flow rate. Small changes in flow rate are indicative of the need for inspection or replacement. If a reliable assessment of bilge pump integrity was available, then a boat operator or engineer could accurately determine the functional efficiency of the bilge pump during normal operations. With this information, a boat operator or engineer could safely approach, or even safely exceed, the advertised service life of the bilge pump, as long as the biloge pump still functioned at an acceptable level of efficiency.

A further need exists for the monitoring of total bilge water effluent. The increase over time of the amount of bilge water pumped from the vessel can be indicative of a worsening leak in the vessel hull.

A related need exists for a method and apparatus for monitoring marine cooling system function which distinguishes cooling system impairment from other potential causes of marine engine overheating.

A need also exists for a method and apparatus for monitoring marine cooling system function which employs direct monitoring of coolant water flow through the cooling system.

An additional need exists for a method and apparatus for directly monitoring coolant water flow through a marine cooling system, which provides timely detection of cooling system impairment to allow the vessel operator to take corrective action against overheating before engine damage or failure occurs.

A further need exists for the monitoring of the long term performance of the impeller or other pump mechanism for the cooling water system. Small changes in flow rate are indicative of the need for inspection or replacement, and under normal operation, the service life of the impeller, or other water pump mechanism could be safely approached or exceeded if a reliable assessment of impeller, or other pump mechanism integrity was available.

SUMMARY OF INVENTION

It is therefore an object of the present invention to provide a method and apparatus for monitoring marine cooling system function which distinguishes cooling system impairment from other potential causes of marine engine overheating.

It is a related object of the invention to achieve the above object in a method and apparatus which monitors cooling system function by monitoring coolant water flow through the cooling system.

It is a further object of the invention to achieve the above objects in a marine cooling system monitoring method and apparatus which provide for timely detection and notification of cooling system impairment, to allow a vessel operator to take corrective action against marine engine overheating due to cooling system impairment before engine damage or failure occurs.

It is yet another object of the invention to achieve the above objects in a marine cooling system monitoring method and device which allows accurate assessment of cooling system function from a remote location, to minimize dangers arising from unmanned vessel operation and direct inspection of equipment.

It is also an object of the present invention to provide a method and apparatus for monitoring bilge water pumping system function by monitoring bilge water outflow through the bilge water pumping system.

It is a related object of the invention to achieve the above object in a marine cooling system monitoring method and apparatus which provide for timely detection and notification of vessel hull leaking, to allow a vessel operator to take corrective action against engine damage, or water damage and/or sinking due to vessel hull leakage, before the engine damage or water damage and/or sinking occurs.

It is a further object of the invention to achieve the above objects in a bilge water pumping system monitoring method and device which allows accurate assessment of bilge water pumping system function from a remote location, to minimize dangers arising from unmanned vessel operation and direct inspection of equipment.

It is yet another object of the invention to achieve the above object in a marine cooling system monitoring method and device and a bilge water pumping system monitoring method and device which allows both systems to be monitored with the same display equipment, to save on the space and expense of two displays, one for each monitored system.

The invention achieves these objects and advantages by providing a method and apparatus for remotely monitoring a functional status of a marine engine cooling system. The method of the invention includes an initial step of sensing whether a flow of cooling water is present or absent in an intake pipe of a marine engine, to establish a sensed flow status of the cooling system. Following the sensing step, a transducible, primary flow status signal reflective of the sensed flow status of the cooling system is provided. The primary signal is then transduced to provide a secondary signal relational with respect to the primary signal. Lastly, the secondary signal is translated to provide a tertiary, operator-detectable, flow status signal, from which a human operator can remotely monitor the functional status of the cooling system.

In a preferred method of the invention, a rate of flow of cooling water in the intake pipe is sensed to establish a sensed cooling water flow rate, to more accurately sense the functional status of the cooling system. The sensed flow rate is reflected in a transducible, primary flow rate signal, which is transduced to provide a secondary signal proportionally variable with respect to the primary signal. The secondary signal is translated to provide a tertiary, operator-detectable, flow rate signal from which a human operator can remotely monitor the cooling water flow rate in the cooling system.

In a preferred embodiment of this invention, a sensor is installed to sense the cooling water flow rate in a marine engine cooling water intake pipe. A transducer then converts the sensed cooling water flow rate to a proportionally variable signal. The proportionally variable signal is then input to a visual display for an instantaneous indication of cooling water flow.

In another preferred embodiment of the invention the transduced variable signal is amplified and processed into a time averaged signal with specific sensed cooling water flow rates corresponding to specific scaled signal values to provide translated time averaged signals. The time averaged signal is then input to a visual display, typically a digital display device, for an instantaneous indication of cooling water flow.

In yet another preferred embodiment of the invention, a method and apparatus for remotely monitoring a functional status of a bilge water pumping system would include an initial step of sensing whether a flow of bilge water is present or absent in a bilge water pipe of a marine engine, to establish a sensed flow status of the bilge water pumping system. Following the sensing step, a transducible, primary flow status signal reflective of the sensed flow status of the bilge water pumping system is provided. The primary signal is then transduced to provide a secondary signal relational with respect to the primary signal. Lastly, the secondary signal is translated to provide a tertiary, operator-detectable, flow status signal, from which a human operator can remotely monitor the functional status of the bilge water pumping system.

In another preferred embodiment of the invention, a rate of flow of bilge water in the bilge water pipe is sensed to establish a sensed bilge water flow rate, to more accurately sense the functional status of the bilge water pumping system. The sensed flow rate is reflected in a transducible, primary flow rate signal, which is transduced to provide a secondary signal proportionally variable with respect to the primary signal. The secondary signal is translated to provide a tertiary, operator-detectable, flow rate signal from which a human operator can remotely monitor the bilge water flow rate in the bilge water pumping system.

In a yet another preferred embodiment of this invention, a sensor is installed to sense the bilge water flow rate in a bilge water pipe. A transducer then converts the sensed bilge water flow rate to a proportionally variable signal. The proportionally variable signal is then input to a visual display for an instantaneous indication of bilge water flow.

In another preferred embodiment of the invention the transduced variable signal is amplified and processed into a time averaged signal with specific sensed bilge water flow rates corresponding to specific scaled signal values to provide translated time averaged signals. The time averaged signal is then input to a visual display, typically a digital display device, for an instantaneous indication of bilge water flow or a bilge water flow rate average over a period of time sufficient to elucidate trends in the leakage rate of the vessel, such as a time period spent in moorage, to display the total amount of water pumped for the time period.

BEST MODE FOR PRACTICING THE INVENTION

Figure 1:
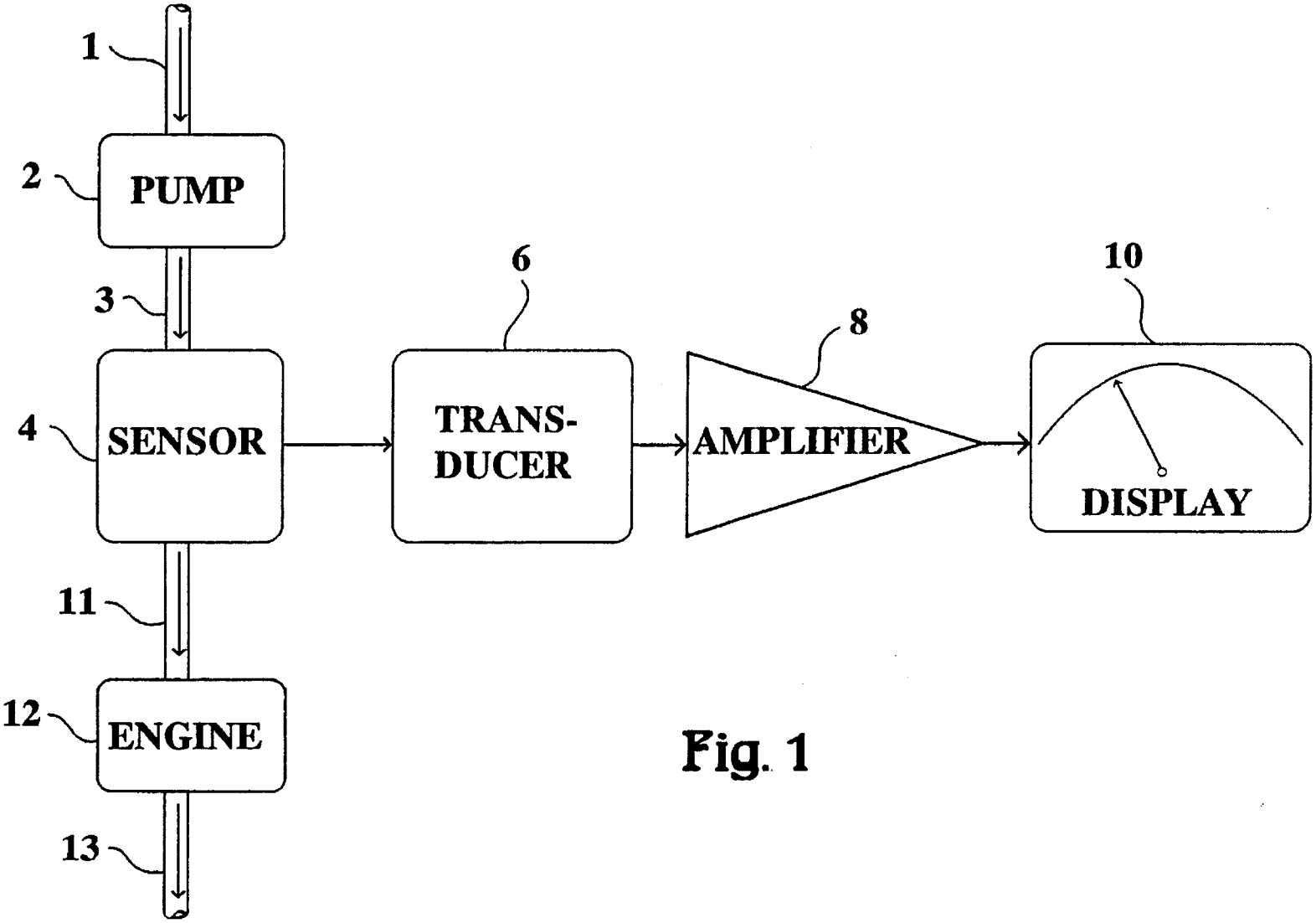
FIG. 1 is a notated schematic diagram of an apparatus for remotely monitoring marine engine cooling water flow, employing the concepts of the present invention.

The invention provides a method for remotely monitoring the functional status of a marine engine cooling system and for remotely monitoring the functional status of a bilge water pumping system. A notated schematic diagram of the portion of the invention providing a method for remotely monitoring the functional status of a marine engine cooling system is shown in FIG. 1. A flow of cooling water in a marine engine intake pipe 3 is sensed by a flow sensing means 4. The sensed cooling water flow rate provided by the flow sensing means is converted into a secondary signal by a transducing means 6. An amplification means 8 is used to amplify the secondary signal from the transducing means.

The secondary signal from the amplification means, now amplified, is input to visual display means 10, displaying the instantaneous rate of engine cooling water flow. With this information visually displayed in a convenient and easy to interpret manner the vessel operator has the opportunity to take corrective action before engine damage resulting from a cooling water system malfunction.

Figure 2:
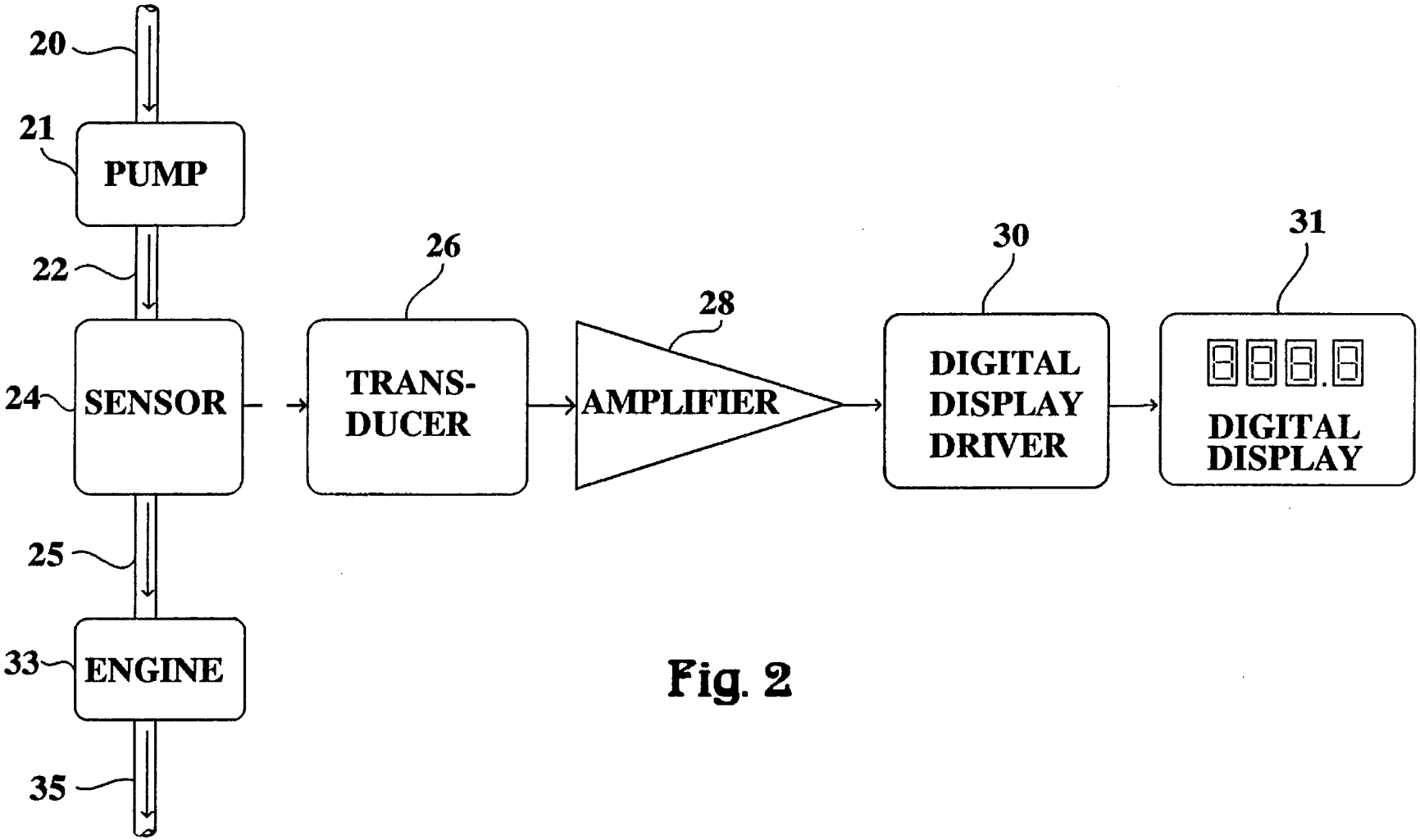
FIG. 2 is a notated schematic diagram of an apparatus for remotely monitoring marine engine cooling water flow including a digital electronic display mechanism, employing the concepts of the present invention.

An alternative preferred embodiment is notated in the schematic diagram shown in FIG. 2. A flow of cooling water in a marine engine cooling water intake pipe 22 is sensed by a flow sensing means 24. The sensed cooling water flow rate provided by the sensing means is converted into a proportionally variable signal by a transducing means 26. An amplification means 28 is used to amplify the proportionally variable signal from the transducing means. The amplified signal from the amplification means is input to a digital display driver means 30. The output from the digital display driver means is input to a digital visual display means 31. The visual display means is typically an electronic digital display device or an electromechanical pointer.

Figure 3A:
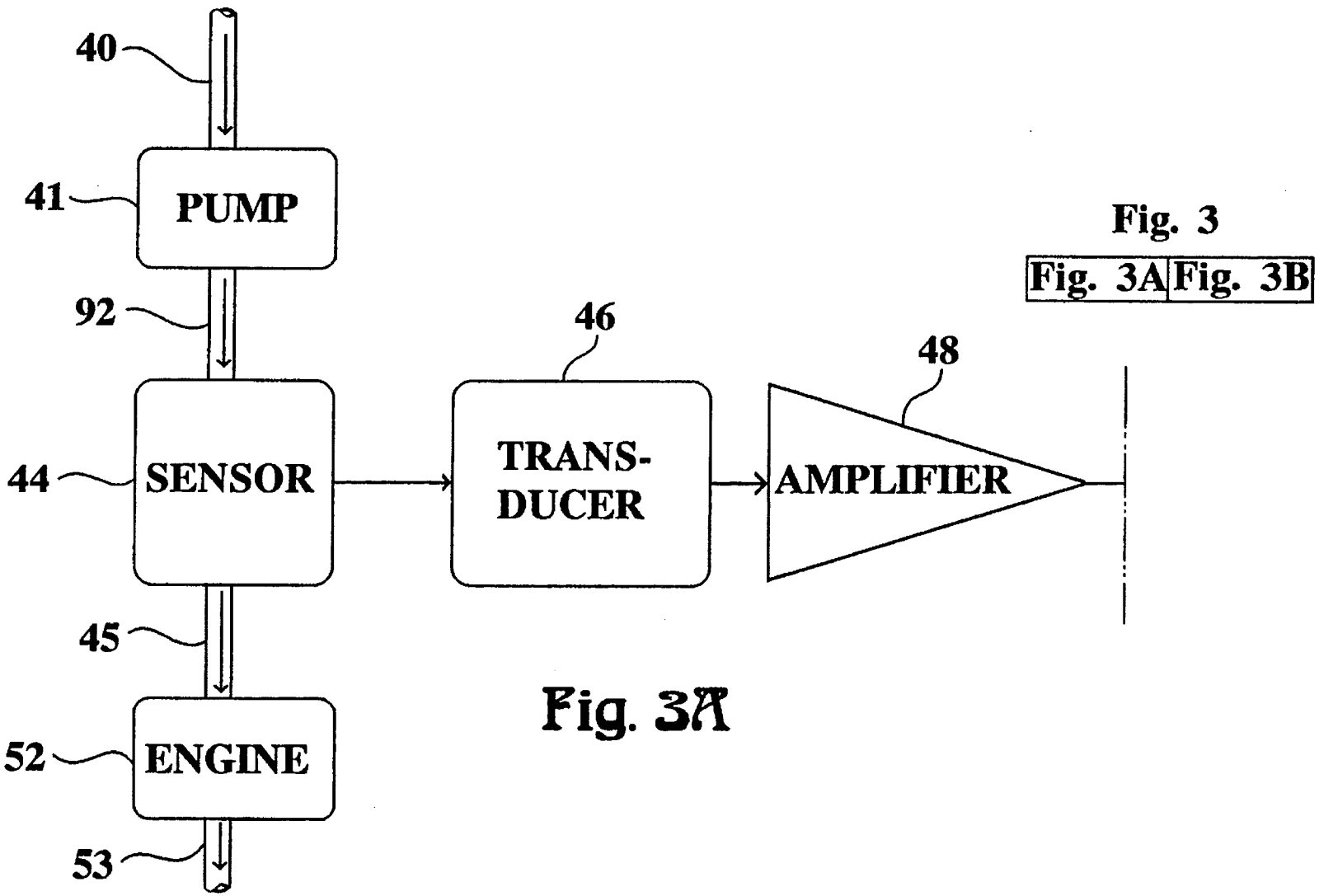
FIG. 3 is a notated schematic diagram of an apparatus for remotely monitoring marine engine cooling water flow including a signal processing unit and a digital electronic display mechanism, employing the concepts of the present invention.
Figure 3B:
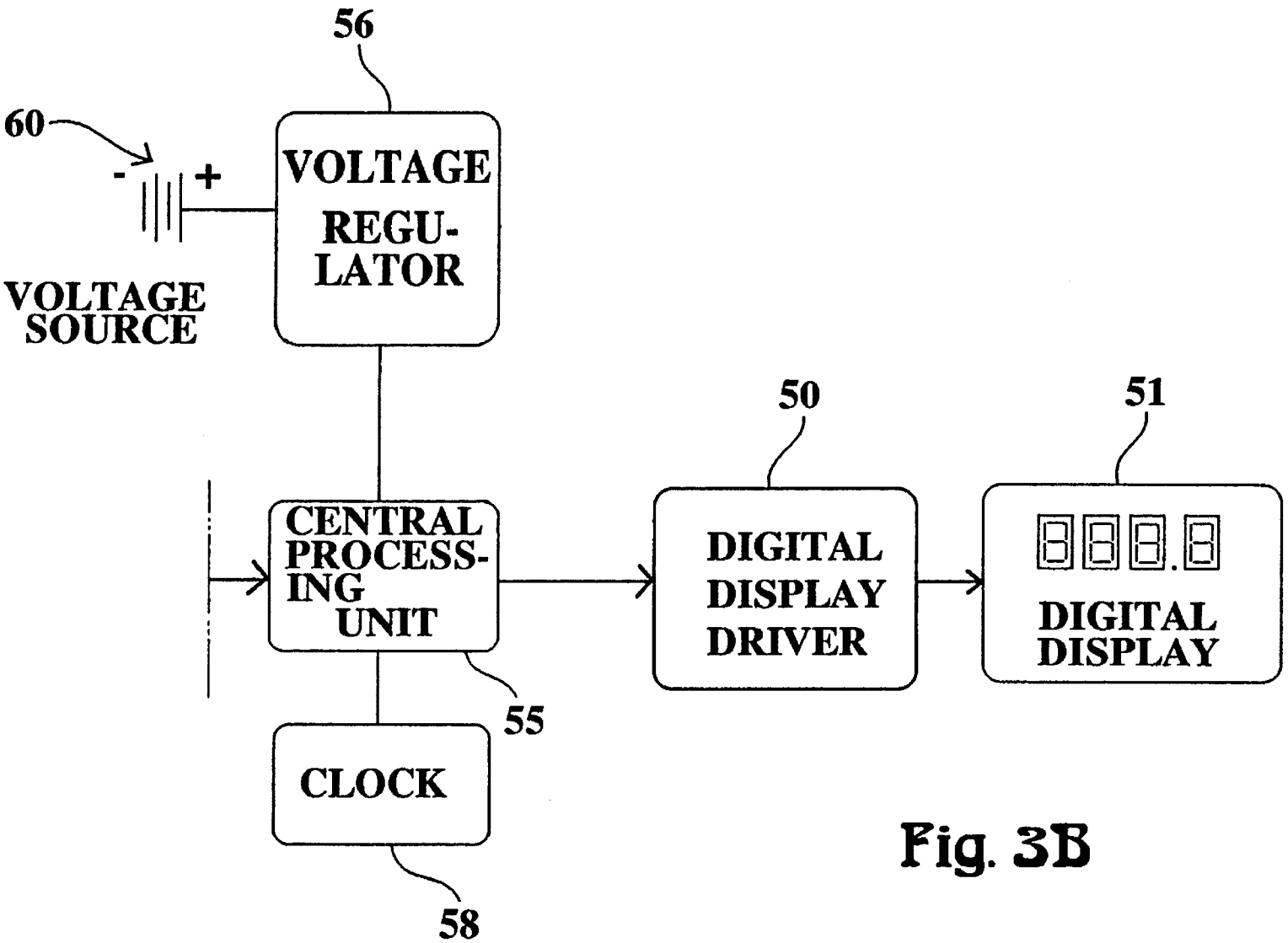

Another preferred embodiment is notated in schematic diagram FIG. 3. A flow of cooling water in a marine engine intake pipe 42 is sensed by a flow sensing means 44. The sensing means sensed cooling water flow is converted into a proportionally variable signal by a transducing means 46. An amplification means 48 is used to amplify the proportionally variable signal from the transducing means. The amplified signal from the amplification means is input to a processing means 55. The processing means translates input into time averaged signal with specific sensed cooling water flow rates relating to specific scaled signal values. Time averaging translation is helpful to reduce the fluctuations observed in an instantaneous reading of cooling water flow.

The processing means 55 relies upon a low signal regulator means 56 for a constant low signal supply and a clock means 58 to provide base timing for rate averaging over time. The processing means supplies input for display driver means 50. The display driver means converts input for the visual display 51. The visual display is typically situated in the instrument panel or another position readily observable by the vessel operator.

The visual display means 51 is typically an electronic digital display device or an electromechanical pointer, with a light or an audible alarm for low or zero coolant water flow rate readings.

Figure 4:
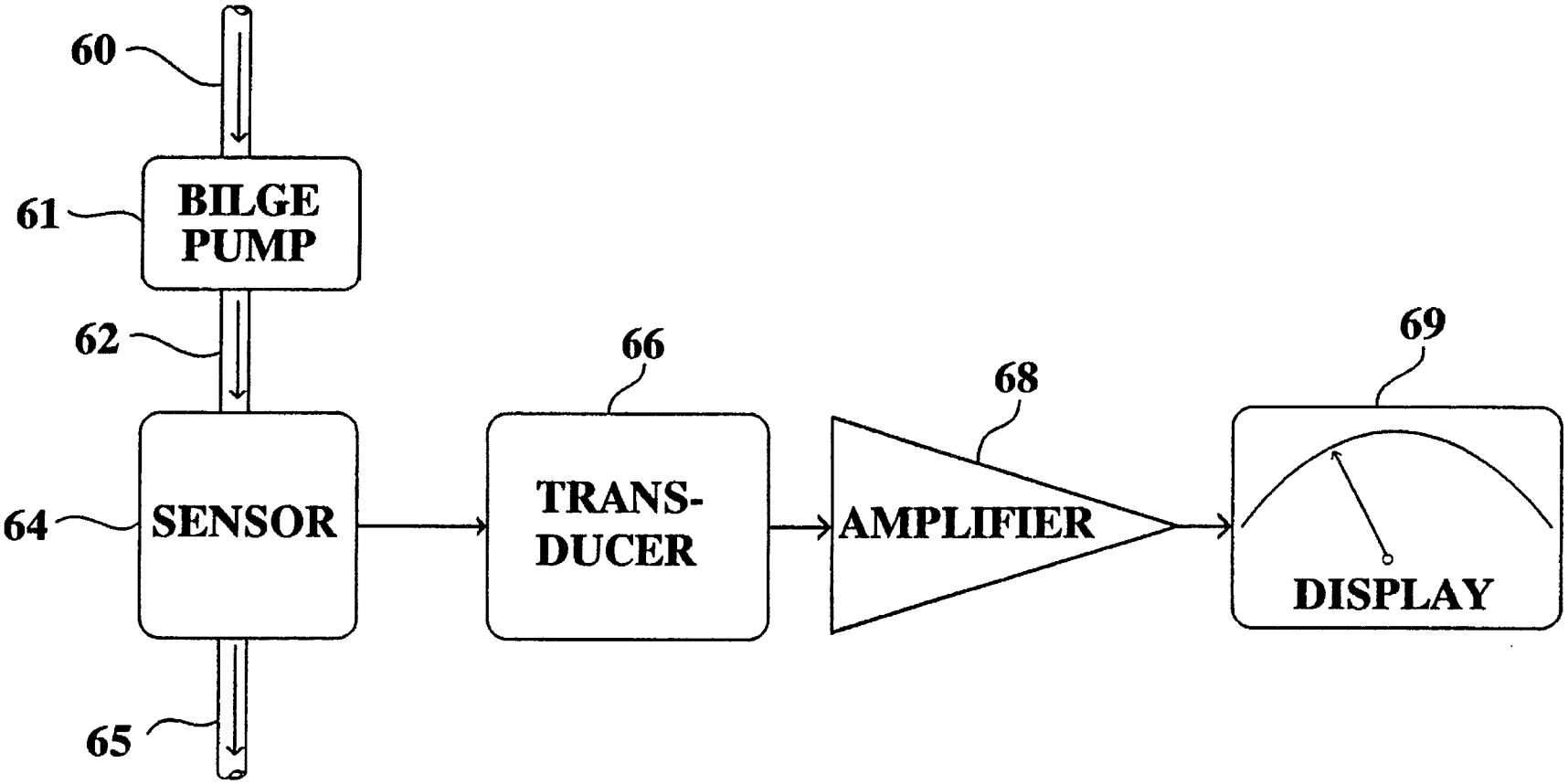
FIG. 4 is a notated schematic diagram of an apparatus for remotely monitoring water flow in a bilge water pumping system, employing the concepts of the present invention.

A notated schematic diagram of the invention for remotely monitoring the functional status of a bilge water pumping system is shown in FIG. 4. A flow of bilge water in a marine vessel bilge water intake pipe 62 is sensed by a flow sensing means 64. The sensed bilge water flow rate provided by the flow sensing means is converted into a secondary signal by a transducing means 66. An amplification means 68 is used to amplify the secondary signal from the transducing means. The secondary signal from the amplification means, now amplified, is input to visual display means 69, displaying the instantaneous rate of bilge water flow.

With this information visually displayed in a convenient and easy to interpret manner the vessel operator has the opportunity to take corrective action before vessel damage or possibly sinking, resulting from a vessel leak or a bilge water pumping system malfunction. The visual display means 69 can also be equipped with a total flow counter (not shown). The total flow counter can be reset prior to a longer period, such as a time period spent in moorage, to display the total amount of water pumped for the time period.

Figure 5:
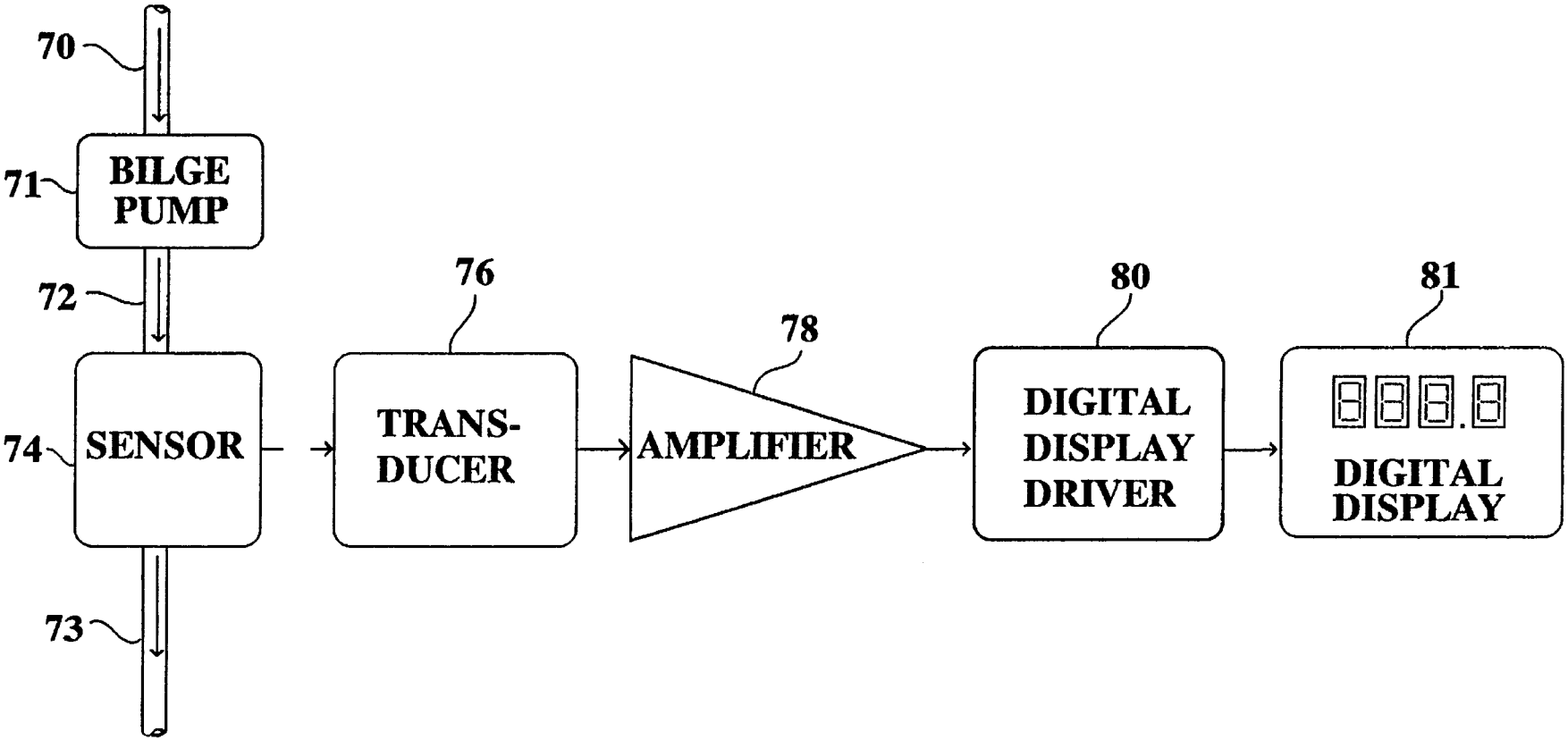
FIG. 5 is a notated schematic diagram of an apparatus for remotely monitoring water flow in a bilge water pumping system including a digital electronic display mechanism, employing the concepts of the present invention.

An alternative preferred embodiment is notated in the schematic diagram shown in FIG. 5. A flow of bilge water in a marine vessel bilge water intake pipe 72 is sensed by a flow sensing means 74. The sensed bilge water flow rate provided by the sensing means is converted into a proportionally variable signal by a transducing means 76. An amplification means 78 is used to amplify the proportionally variable signal from the transducing means. Amplified signal from the amplification means is input to a digital display driver means 80. The output from the digital display driver means is input to a digital visual display means 81. The visual display means is typically an electronic digital display device or an electromechanical pointer. The visual display means 81 can also be equipped with a total flow counter (not shown). The total flow counter can be reset prior to a longer period, such as a time period spent in moorage, to display the total amount of water pumped for the time period.

Figure 6A:
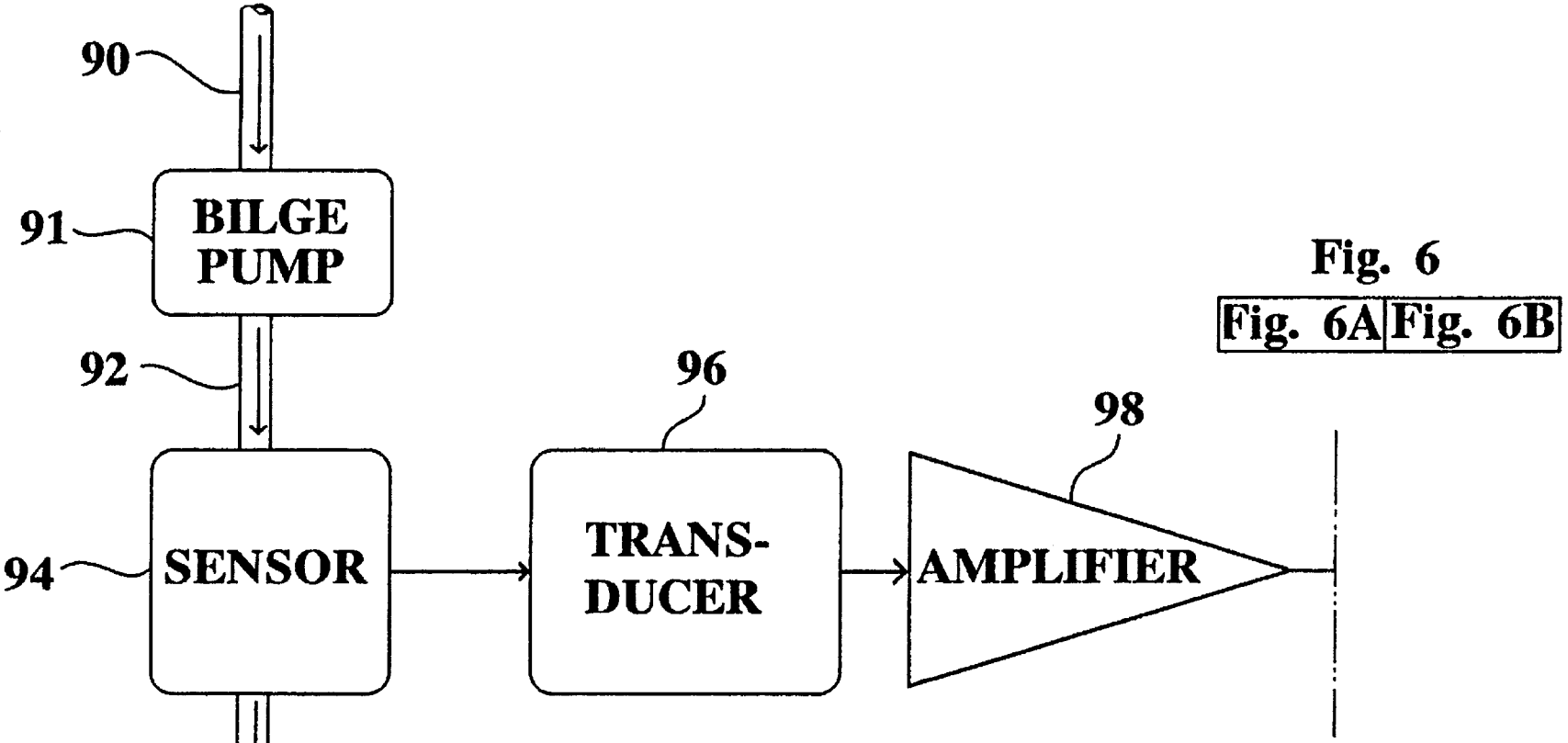
FIG. 6 is a notated schematic diagram of an apparatus for remotely monitoring water flow in a bilge water pumping system including a signal processing unit and a digital electronic display mechanism, employing the concepts of the present invention.
Figure 6B:
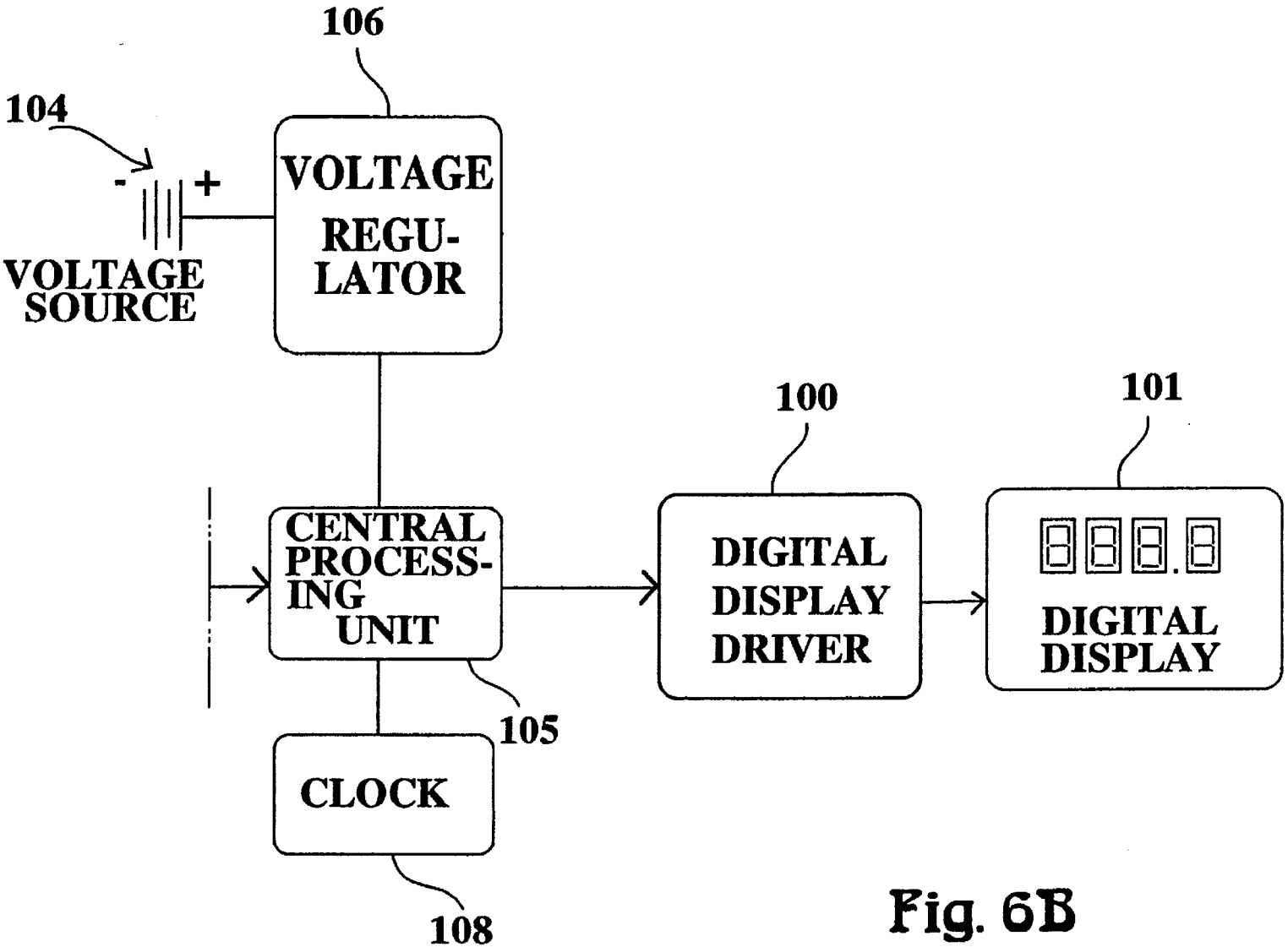

Another preferred embodiment is notated in schematic diagram FIG. 6. A flow of bilge water in a marine vessel bilge water system intake pipe 92 is sensed by a flow sensing means 94. The sensing means sensed bilge water flow is converted into a proportionally variable signal by a transducing means 96. An amplification means 98 is used to amplify the proportionally variable signal from the transducing means. The amplified signal from the amplification means is input to a processing means 105. The processing means translates input into a time averaged signal with specific sensed bilge water flow rates relating to specific scaled signal values. Time averaging translation is helpful to reduce the fluctuations observed in an instantaneous reading of bilge water flow. For a longer period, such as a time period spent in moorage, the total amount of water pumped during the period can be displayed.

The processing means 105 relies upon a low signal regulator means 106 for a constant low signal supply and a clock means 108 to provide base timing for rate averaging over time. The processing means supplies input for display driver means 100. The display driver means converts input for the visual display 101. The visual display is typically situated in the instrument panel or another position readily observable by the vessel operator. The visual display means 101 is typically an electronic digital display device or an electromechanical pointer, with a light or an audible alarm for high bilge water flow rate readings.

Figure 7A:
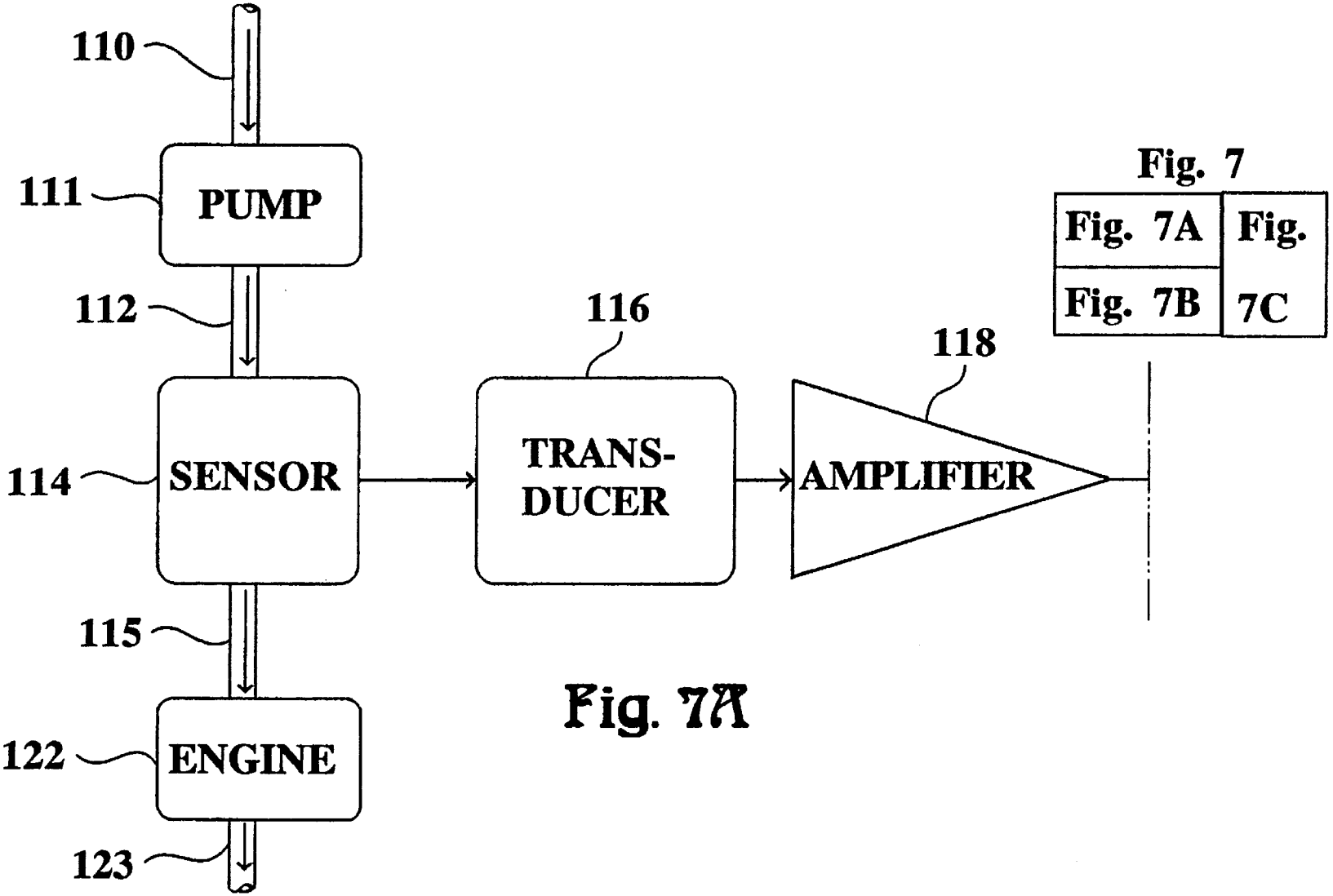
FIG. 7 is a notated schematic diagram of an apparatus for remotely monitoring marine engine cooling water flow combined with an apparatus for remotely monitoring water flow in a bilge water pumping system, employing the concepts of the present invention.
Figure 7B:
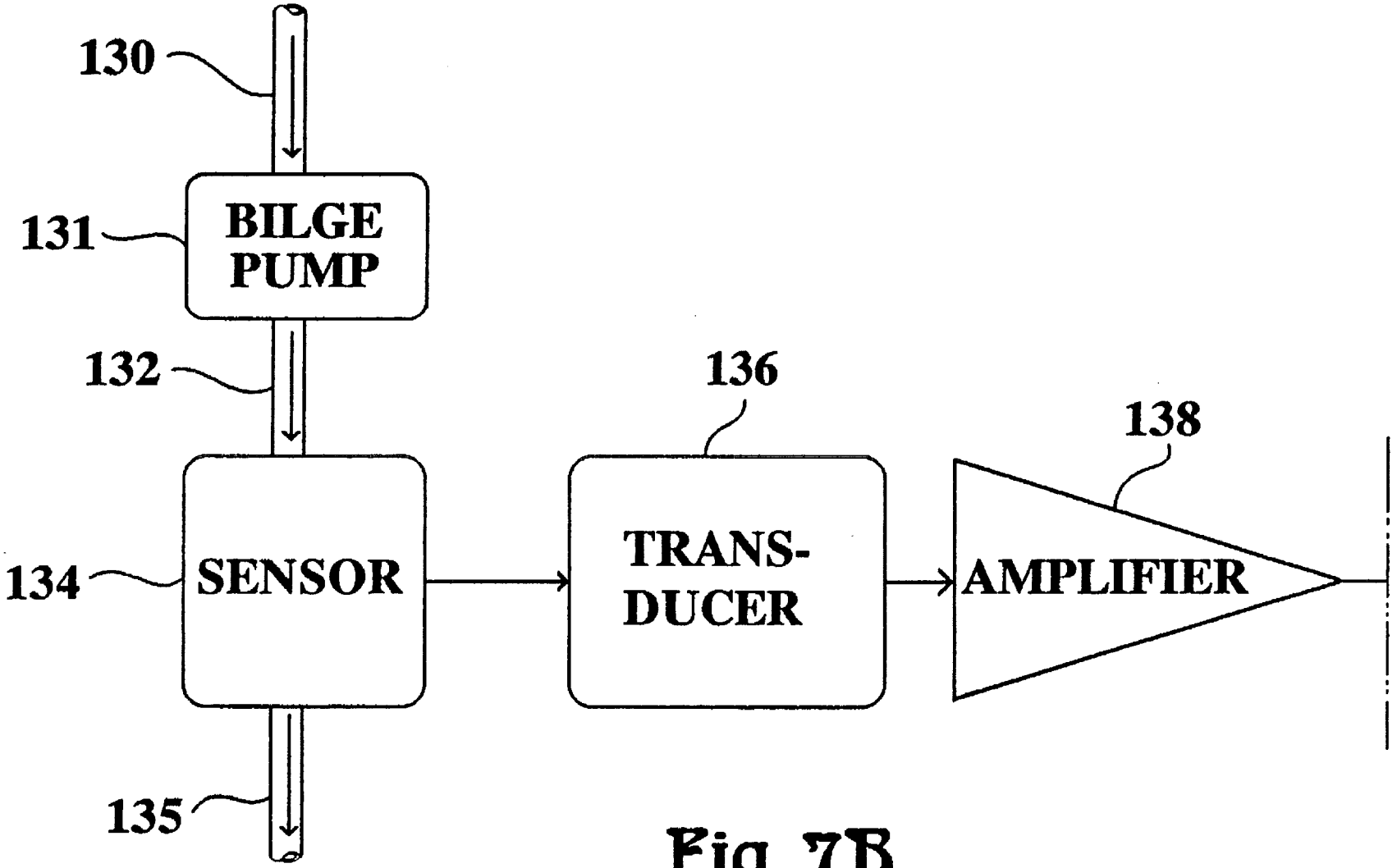
Figure 7C:
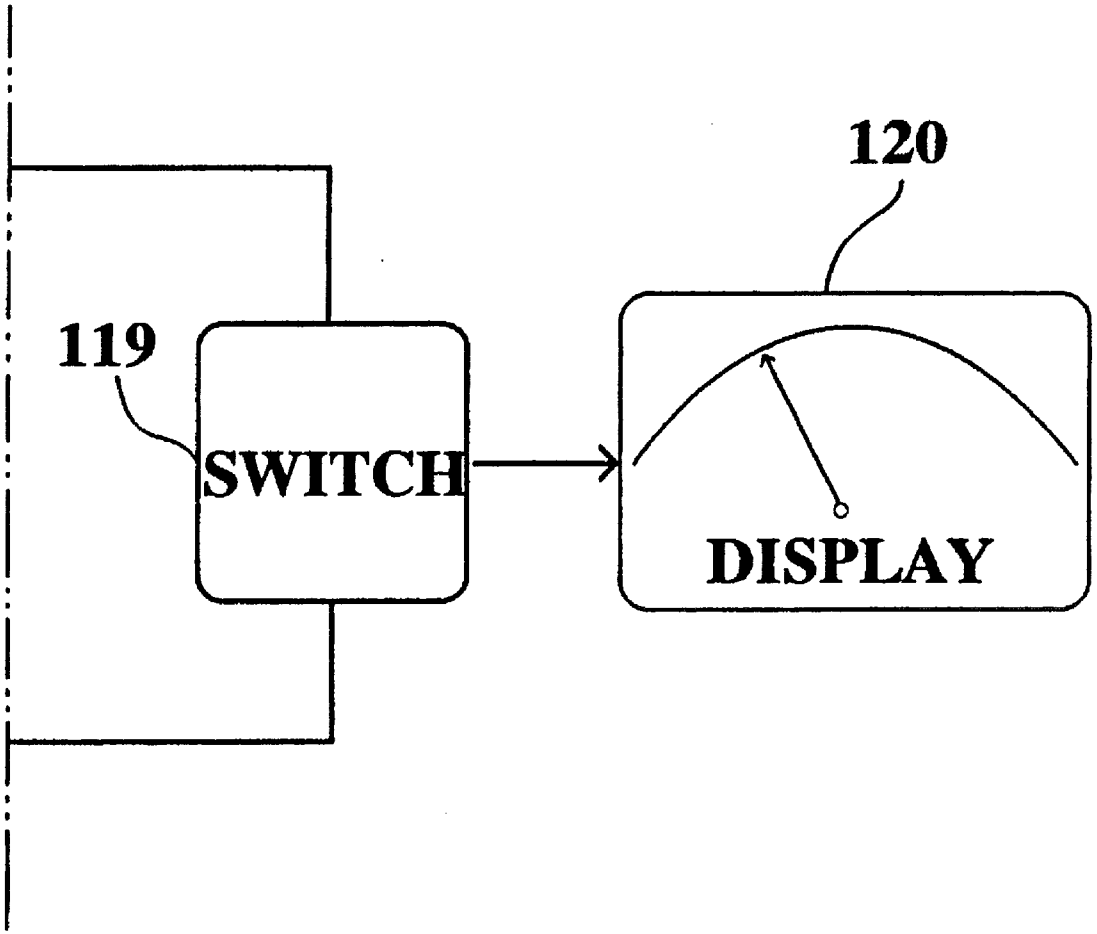

A notated schematic diagram of the invention for remotely monitoring the functional status of a marine engine cooling system and the functional status of a bilge water pumping system is shown in FIG. 7. A flow of cooling water in a marine engine intake pipe 112 is sensed by a flow sensing means 114. The sensed cooling water flow rate provided by the flow sensing means is converted into a secondary signal by a transducing means 116. An amplification means 118 is used to amplify the secondary signal from the transducing means. An amplified signal from the amplification means is input to a visual display means 120, through switch 119, thereby displaying the instantaneous rate of engine cooling water flow. The visual display means is typically an electronic digital display device or an electromechanical pointer.

Also, a flow of bilge water in a marine vessel bilge water intake pipe 132 is sensed by a flow sensing means 134. The sensed bilge water flow rate provided by the flow sensing means is converted into a secondary signal by a transducing means 136. An amplification means 138 is used to amplify the secondary signal from the transducing means. The secondary signal from the amplification means, now amplified is input to visual display means 120, through switch 119, thereby displaying an instantaneous rate of bilge water flow. The visual display means 120 can also be equipped with a total flow counter (not shown). The total flow counter can be reset prior to a longer period, such as a time period spent in moorage, to display the total amount of water pumped for the time period.

Switch 119 enables the operator to manually alternate input to the visual display means 120 between cooling water flow monitoring and bilge water flow monitoring. With this information visually displayed in a convenient and easy to interpret manner the vessel operator has the opportunity to take corrective action before additional engine and vessel damage resulting from either a cooling water system malfunction, bilge water pumping system malfunction or vessel hull leakage.

Figure 8A:
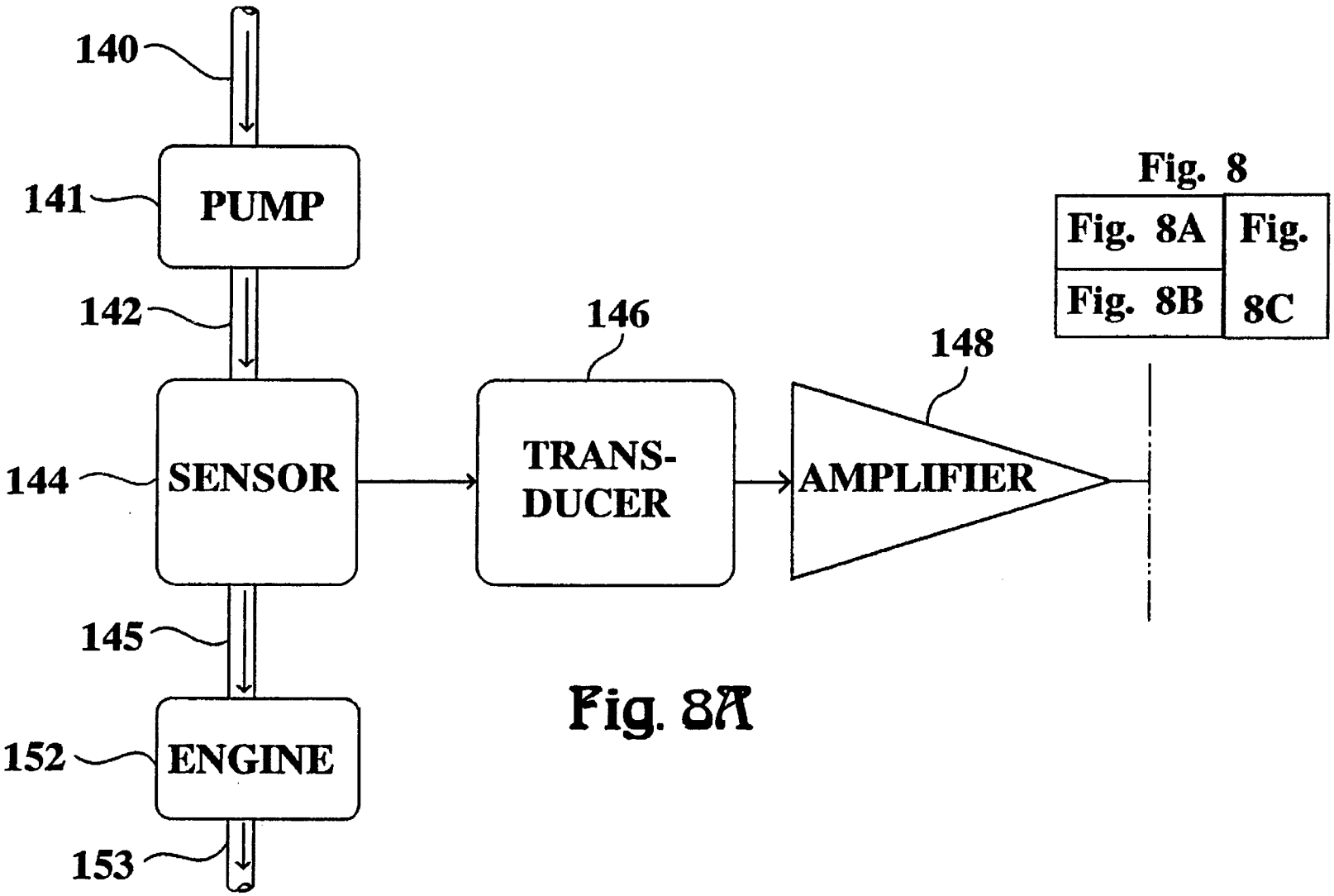
FIG. 8 is a notated schematic diagram of the bilge water pumping system and an apparatus for remotely monitoring marine engine cooling water flow, also including a digital electronic display mechanism, employing the concepts of the present invention.
Figure 8B:
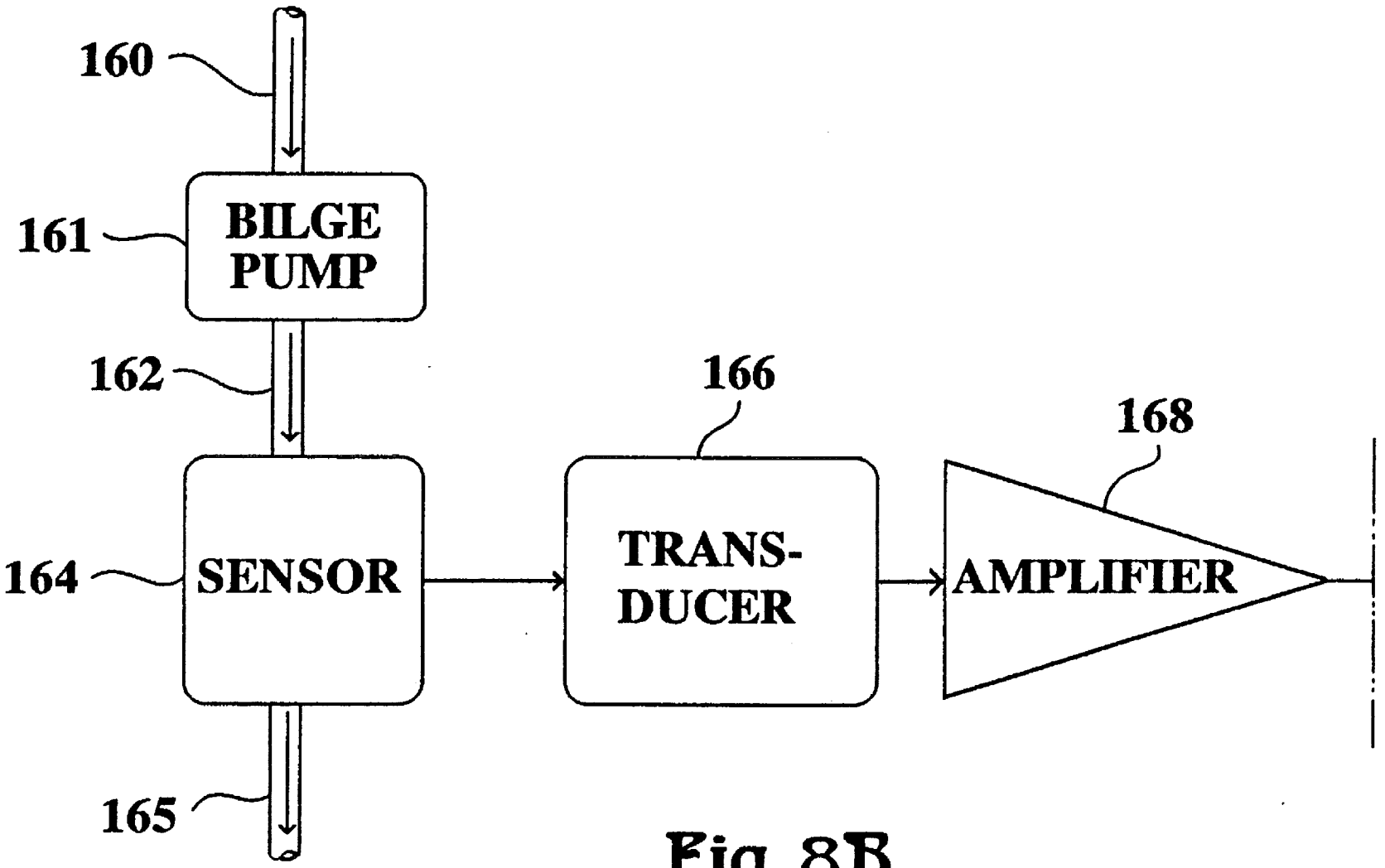
Figure 8C:
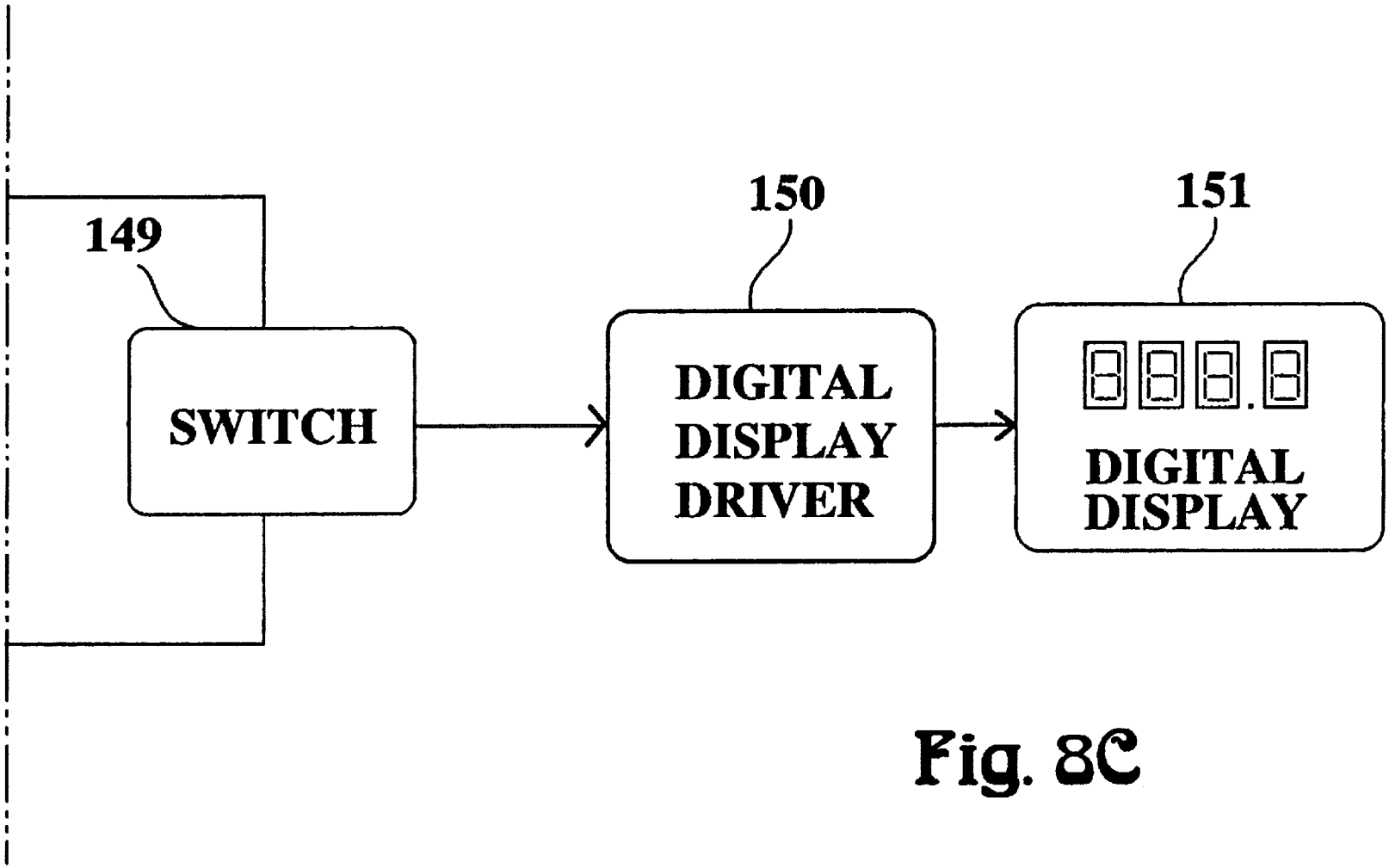

An alternative preferred embodiment is notated in the schematic diagram shown in FIG. 8. A flow of cooling water in a marine engine intake pipe 142 is sensed by a flow sensing means 144. The sensing means sensed cooling water flow is converted into a proportionally variable signal by a transducing means 146. An amplification means 148 is used to amplify the proportionally variable signal from the transducing means. An amplification means 148 is used to amplify the proportionally variable signal from the transducing means. An amplified signal from the amplification means is input to a digital display driver means 150, through switch 149. The output from the digital display driver means is input to a digital visual display means 151. The visual display means is typically an electronic digital display device or an electromechanical pointer. The visual display means is typically situated in the instrument panel or another position readily observable by the vessel operator. The visual display means 151 is typically an electronic digital display device or an electromechanical pointer, with a light or an audible alarm for low or zero coolant water flow rate readings.

Also, a flow of bilge water in a marine vessel bilge water intake pipe 162 is sensed by a flow sensing means 164. The sensed bilge water flow rate provided by the sensing means is converted into a proportionally variable signal by a transducing means 166. An amplification means 168 is used to amplify the proportionally variable signal from the transducing means. Amplified signal from the amplification means is input to a digital display driver means 150. The output from the digital display driver means is input to a digital visual display means 151. The visual display means is typically an electronic digital display device or an electromechanical pointer. The visual display means 151 can also be equipped with a total flow counter (not shown). The total flow counter can be reset prior to a longer period, such as a time period spent in moorage, to display the total amount of water pumped for the time period.

Switch 119 enables the operator to manually alternate input to the digital display driver means 150, and then to the digital visual display means 151, between cooling water flow monitoring and bilge water flow monitoring.

Figure 9A:
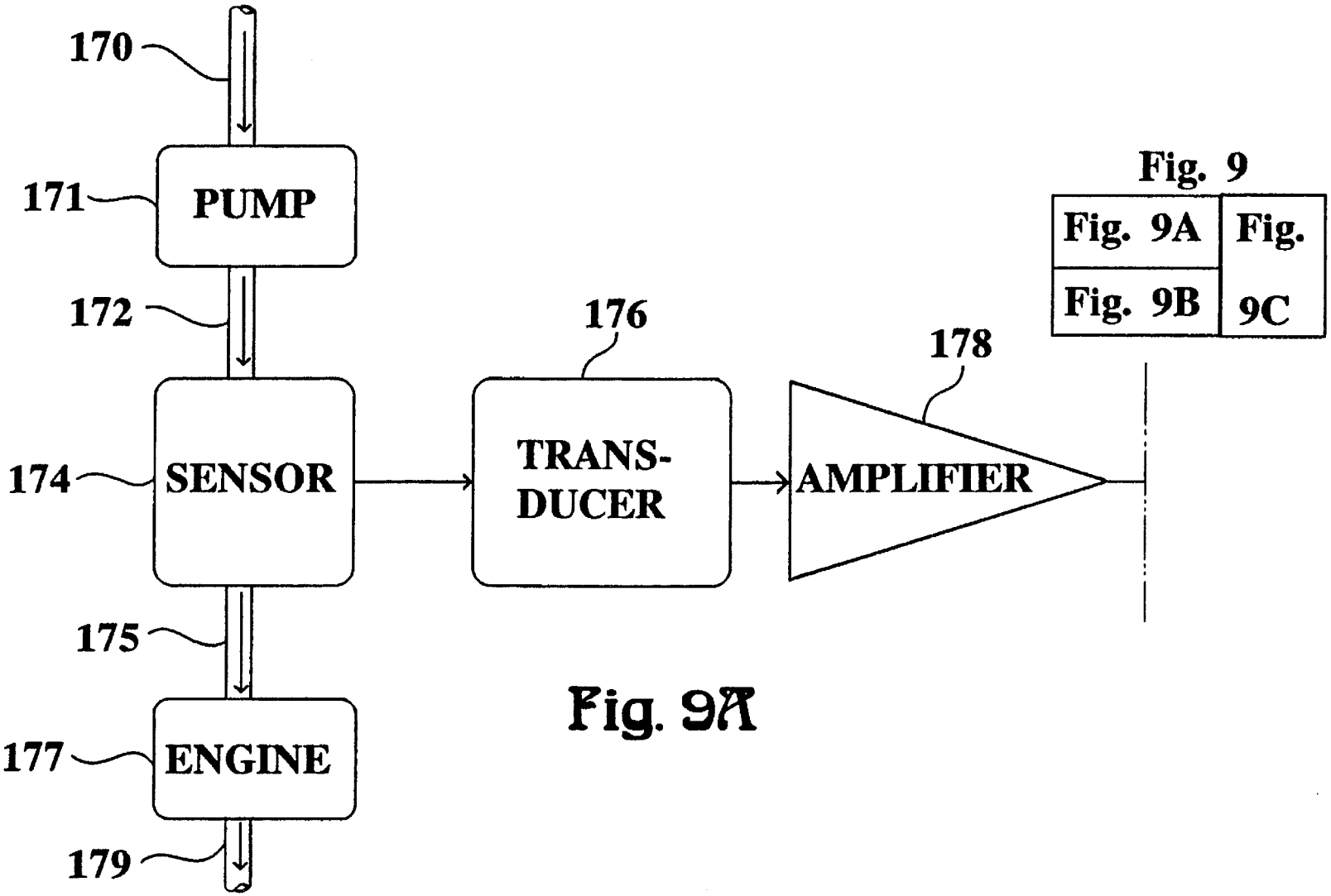
FIG. 9 is a notated schematic diagram of the bilge water pumping system and an apparatus for remotely monitoring marine engine cooling water flow, also including a signal processing unit and a digital electronic display mechanism, employing the concepts of the present invention.
Figure 9B:
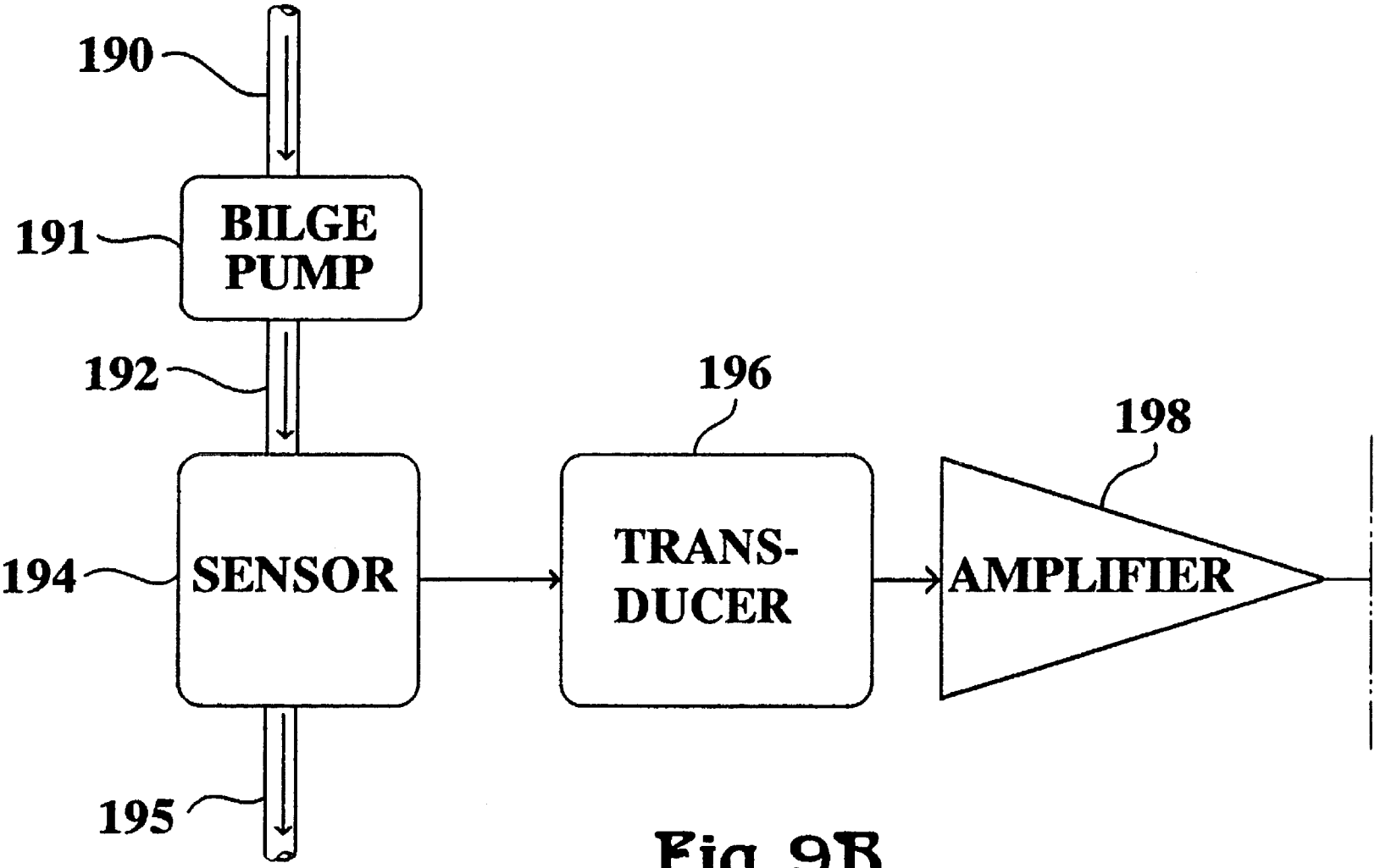
Figure 9C:
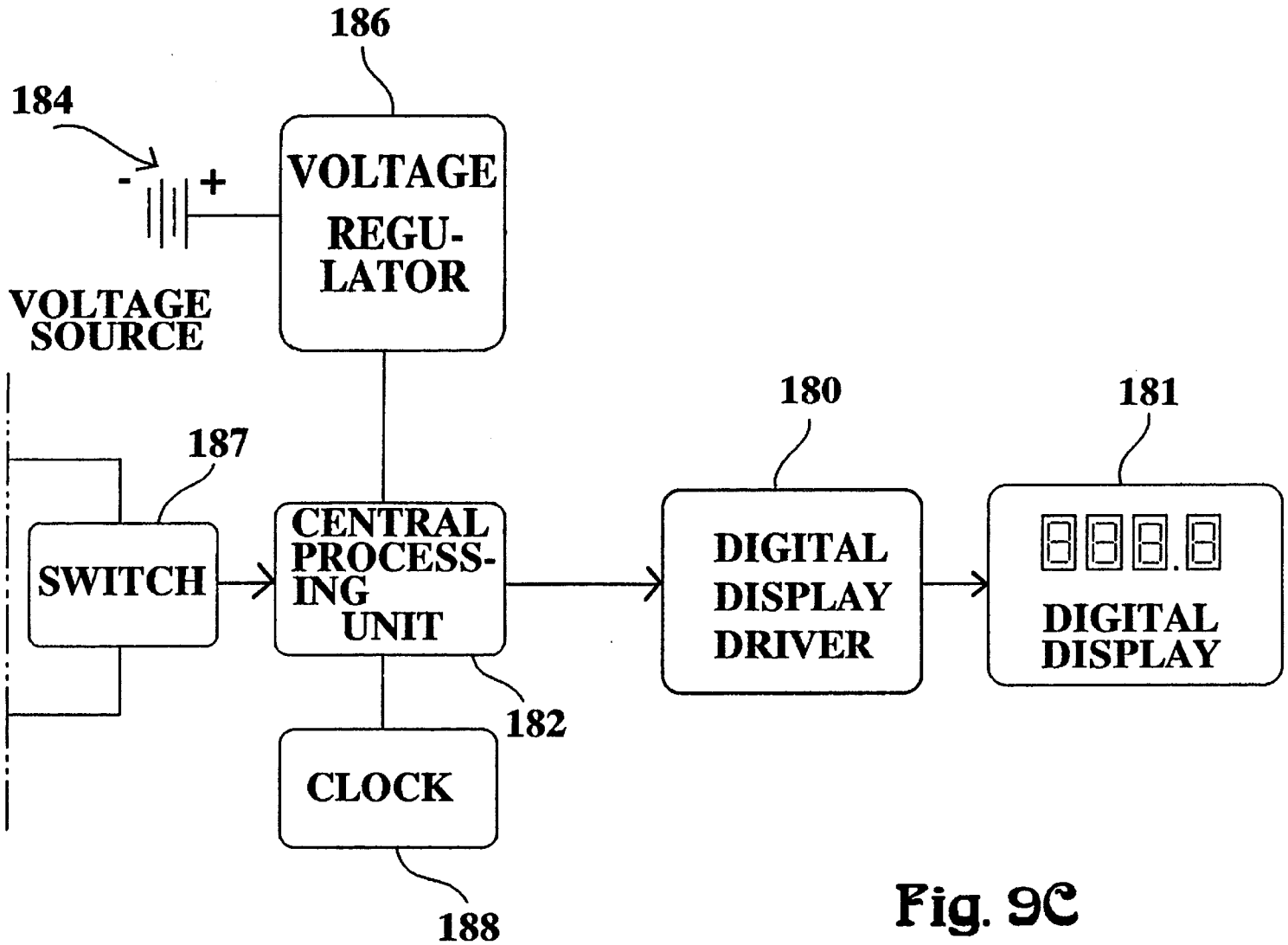

Another preferred embodiment is notated in schematic diagram FIG. 9. A flow of cooling water in a marine engine intake pipe 172 is sensed by a flow sensing means 174. The sensing means sensed cooling water flow is converted into a proportionally variable signal by a transducing means 176. An amplification means 178 is used to amplify the proportionally variable signal from the transducing means. The amplified signal from the amplification means is input to a processing means 182. The processing means translates input into a time averaged signal with specific sensed cooling water flow rates relating to specific scaled signal values. Time averaging translation is helpful to reduce the fluctuations observed in an instantaneous reading of cooling water flow.

The processing means 182 relies upon a low signal regulator means 186 for a constant low signal supply and a clock means 188 to provide base timing for rate averaging over time. The processing means supplies input for display driver means 180. The display driver means converts input for the visual display 181. The visual display is typically situated in the instrument panel or another position readily observable by the vessel operator.

The visual display means 181 is typically an electronic digital display device or an electromechanical pointer, with a light or an audible alarm for low or zero coolant water flow rate readings.

Also, a flow of bilge water in a marine vessel bilge water system intake pipe 192 is sensed by a flow sensing means 194. The sensing means sensed bilge water flow is converted into a proportionally variable signal by a transducing means 196. An amplification means 198 is used to amplify the proportionally variable signal from the transducing means. The amplified signal from the amplification means is input to a processing means 182. Processing means translates input into time averaged signal with specific sensed bilge water flow rates relating to specific scaled signal values. Time averaging translation is helpful to reduce the fluctuations observed in an instantaneous reading of bilge water flow.

The processing means 182 relies upon a low signal regulator means 186 for a constant low signal supply and a clock means 188 to provide base timing for rate averaging over time. The processing means supplies input for display driver means 180. The display driver means converts input for the visual display 181. The visual display is typically situated in the instrument panel or another position readily observable by the vessel operator.

The visual display means 181 is typically an electronic digital display device or an electromechanical pointer, with a light or an audible alarm for high bilge water flow rate readings. The visual display means 181 can also be equipped with a total flow counter (not shown). The total flow counter can be reset prior to a longer period, such as a time period spent in moorage, to display the total amount of water pumped for the time period.

Switch 187 enables the operator to manually alternate input to the digital display driver means 180, and then to the digital visual display means 181, between cooling water flow monitoring and bilge water flow monitoring.

In a preferred embodiment of the invention, a vessel is retro-fitted with the equipment required to achieve an instrument panel indication of proper cooling water and bilge water flow. The transducing means 176 or 196 is combined with the sensing means 174 or 194 in an Omega Engineering brand flow sensor, model numbers FPS5100 or FPS5300, which produce a proportionally variable signal which is a proportionally variable electrical frequency. The amplification means 178 or 198 is a OP AMP model numbers LM301 or LM741. The processing means 182 is an Intel 8051 chip. The voltage regulation means 186 is a Fairchild 7805. The clock means 188 is a Mouser model number 332-5120. The display driver means 180 is a General Instrument model number MAN3810. The display means 181 is an Industrial Electronic Engineer, Inc., model number LR37784R.

Alternatively, any flowmeter which has the ability to sense liquid flow in a pipe in a marine environment may be selected as a combination of the sensing means 174 or 194 and transducing means 176 or 196.

Also alternatively, the transducing means may be any available means which will support the sensing means selected. Since electrical connections easily corrode in marine environments, alternatives such as pneumatic pressure or fiber optics are contemplated.

Also alternatively, a electromechanical pointer can be used instead of a digital display. Vessel operators often find an analog gauge preferable to a digital readout.

Also alternatively, the cooling system flow and the bilge pump system flow displays can be combined in one unit with the necessary switches to alternate the system and specific monitored qualities desired for observation. This enables the comparison of these critical and quite possibly interrelated water pumping systems on board a vessel. A failure of the cooling water system may result in an increase in bilge water pumping due to an internal rupture in the cooling water system. This type of failure would be observable in a combined remote display, but otherwise not perceived unless by direct observation of the cooling system leak or further failures resulting from the leaking cooling water.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

We claim:

1. A method for remotely and instantaneously monitoring a cooling water flow rate in a marine engine cooling system comprising the steps of:

a) sensing an instantaneously variable rate of flow of cooling water using a sensor located in a cooling water intake pipe of a marine engine;

b) providing a primary signal to establish an instantaneously sensed cooling water flow rate;

c) transducing the primary signal to provide a secondary flow rate signal proportionally variable with respect to the primary signal; and d) translating the secondary signal to provide a tertiary, operator-detectable flow rate signal, proportionally variable in relation to the primary signal to provide an instantaneous indication of the instantaneously variable rate of flow, whereby an operator of the marine engine can monitor the tertiary signal and thereby remotely, instantaneously monitor the cooling water flow rate in the marine engine cooling system.

2. The method of claim 1, including the step of processing the secondary signal before the translating step to yield a time averaged secondary signal having signal values proportionally variable in relation to specific time averaged sensed cooling water flow rates.

3. An apparatus for remotely and instantaneously monitoring a cooling water flow rate in a marine engine cooling system comprising:

a) a flow sensor located in a cooling water intake pipe of a marine engine for sensing an instantaneously variable cooling water flow rate in the cooling water intake pipe;

b) means for generating a primary signal to establish an instantaneously sensed cooling water flow rate;

c) transducing means for transducing the primary signal to provide a secondary flow rate signal proportionally variable in relation to the primary signal; and d) translation means for translating the secondary signal to provide a tertiary, operator-detectable flow rate signal, proportionally variable in relation to the primary signal to provide an instantaneous indication of the instantaneously variable rate of flow, whereby an operator of the marine engine can monitor the tertiary signal and thereby remotely, instantaneously monitor the cooling water flow rate in the marine engine cooling system.

4. The apparatus of claim 3, further comprising a processing means to convert the secondary signal into a time averaged secondary signal having signal values proportionally variable in relation to specific time averaged sensed cooling water flow rates.

5. The apparatus of claim 4, further comprising a display means to translate the time averaged signals to a visual display.

6. The apparatus of claim 4, wherein the processing means further comprises:

a) a low voltage regulator means for supplying constant low voltage;

b) a clock means for providing base timing for rate averaging over time;

c) a scale conversion means for changing the secondary signal to a different signal scale with a control program stored in the memory of the processing means; and d) a precision voltage reference means to accurately maintain a desired time averaged voltage independent of any voltage regulator variation.

7. The apparatus of claim 3, wherein the visual display means is an electronic digital visual display device and is equipped with a processing display driver means.

8. A method for remotely and instantaneously monitoring a bilge water flow rate in a bilge water pumping system comprising the steps of:

a) sensing an instantaneously variable rate of flow of bilge water in a bilge water intake pipe of a marine vessel and providing a primary signal to establish an instantaneously sensed bilge water flow rate;

b) transducing the primary signal to provide a secondary flow rate signal proportionally variable with respect to the primary signal; and c) translating the secondary signal to provide a tertiary, operator-detectable flow rate signal, proportionally variable in relation to the primary signal to provide an instantaneous indication of the instantaneously variable rate of flow, whereby an operator of the bilge water pumping system can monitor the tertiary signal and thereby remotely instantaneously monitor the bilge water flow rate in the bilge water pumping system.

9. The method of claim 8, including the step of processing the secondary signal before the translating step to yield a time averaged secondary signal having signal values proportionally variable in relation to specific time averaged sensed bilge water flow rates.

10. An apparatus for remotely and instantaneously monitoring a bilge water flow rate in a bilge water pumping system comprising:

a) a flow sensor for sensing an instantaneously variable bilge water flow rate in a bilge water outflow pipe of a marine vessel;

b) means for generating a primary signal to establish an instantaneously sensed bilge water flow rate;

c) a transducer for transducing the primary signal to provide a secondary flow rate signal proportionally variable in relation to the primary signal; and d) a translation means for translating the secondary signal to provide a tertiary, operator-detectable flow rate signal, proportionally variable with respect to the primary signal to provide an instantaneous indication of the instantaneously variable rate of flow, whereby an operator of the marine vessel can monitor the tertiary signal and thereby remotely, instantaneously monitor the bilge water flow rate in the bilge water pumping system.

11. The apparatus of claim 10, further comprising a processing means to convert the secondary signal into a time averaged secondary signal having signal values proportionally variable in relation to specific time averaged sensed bilge water flow rates.

12. The apparatus of claim 11, further comprising a display means to translate the time averaged signals to a visual display.

13. The apparatus of claim 11, wherein tile processing means further comprises:

a) a low voltage regulator means for supplying constant low voltage;

b) a dock means to providing base timing for rate averaging over time;

c) a scale conversion means for changing the secondary signal to a different signal scale with a control program stored in the memory of the processing means;

d) a precision voltage reference means to accurately maintain a desired time averaged voltage independent of any voltage regulator variation.

14. The apparatus of claim 12, wherein the visual display means is an electronic digital visual display device and is equipped with a processing display driver means.

15. The apparatus of claim 12, wherein the visual display means additionally displays the total volume of bilge water pumped by tile bilge water pumping system during a specified time period.

16. The apparatus of claim 12, wherein the visual display means is a combined visual display device for simultaneously or alternatively displaying time averaged flow rates for a marine engine cooling system and the bilge water pumping system, the display being equipped with a processing display driver means.

* * * * *

UNITED STATES PATENT AND TRADEMARK OFFICE
Certificate

Patent No. 5,467,643 Patented: November 21, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael L. Barnett, Coquille, OR.

Signed and Sealed this Sixth Day of July 2004.

EDWARD LEFKOWITZ
*Supervisory Patent Examiner*
Art Unit 2855